United States Patent [19]

Solla

[11] 4,194,086

[45] Mar. 18, 1980

[54] SUSPENDED STEREO CONSOLE AND LIGHT SHOW

[76] Inventor: Anthony Solla, 5425 Valles Ave., Bronx, N.Y. 10471

[21] Appl. No.: 858,191

[22] Filed: Dec. 7, 1977

[51] Int. Cl.[2] ..... H04R 5/02

[52] U.S. Cl. ..... 179/1 G; 179/1 J; 179/1 GA

[58] Field of Search ..... 40/473, 414, 427, 428, 40/429, 455; 248/318; 179/1 J, 1 G, 1 GA, 1 M

[56] References Cited

U.S. PATENT DOCUMENTS

| | | | |
|---|---|---|---|
| 1,790,903 | 2/1931 | Craig | 40/455 |
| 2,092,761 | 9/1937 | Klein | 40/473 X |
| 2,629,044 | 2/1953 | Marfisi | 40/431 |
| 3,388,218 | 6/1968 | Hurvitz | 179/1 J |
| 3,462,866 | 8/1969 | Denson | 40/473 |
| 3,520,559 | 7/1970 | Ross | 179/1 J |
| 3,781,475 | 12/1973 | Sharp | 179/1 J |

FOREIGN PATENT DOCUMENTS

| | | | |
|---|---|---|---|
| 17564 of 1891 | | United Kingdom | 40/473 |
| 882010 | 11/1961 | United Kingdom | 40/455 |

*Primary Examiner*—Douglas W. Olms
*Attorney, Agent, or Firm*—Howard I. Podell

[57] ABSTRACT

A rotatable console housing can be mounted on a support plate attached to a column mounted to the ceiling of a room. The housing can be rotated on the column using a motor pulleys and a belt with the power delivered to the motor through a set of brushes mounted on the support plate. A stereo unit mounted in the housing can be connected to the brushes and to a set of speakers for audio output and to a light bulb for a visual display. The light bulb can use a grating representation of flames together with internally mounted bulbs to produce the effect of flames responsive to the stereo unit output.

3 Claims, 2 Drawing Figures

SUSPENDED STEREO CONSOLE AND LIGHT SHOW

I have invented a new and novel suspended stereo console and light display. My device can provide a visual display representation of flames which will vary in response to the rhythm of the sounds being produced by the stereo components of this device. Furthermore, this console can rotate upon the press of a button or the operation of a switch so that the sounds may be directed to the various parts of the room as the console rotates. The grating effect surrounding the light display bulbs produce the flame effect using a miniature synthesizer and light grating screen. Still further, it is to be noted that this console is oval in cross section and can be of value in a home or in a disco establishment or in a night club or in a restaurant wherein the aesthetics of this suspended stereo console can be properly enjoyed. The console contains a stereo component connected to speakers mounted in the console and to the light display bulb attached to the lower portion of the console. The electrical components are connected through a support plate to the outside electrical source and the console is rotated by a rotater motor mounted within the console.

My invention can be understood in view of the accompanying figures.

Figure 1:
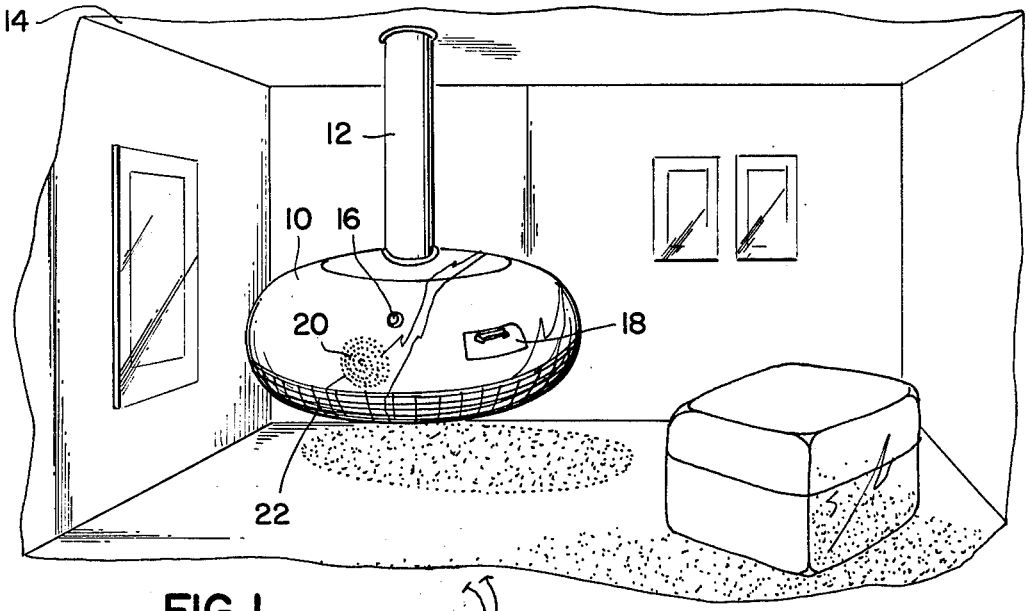
FIG. 1 is a perspective view of the device mounted in a room.
Figure 2:
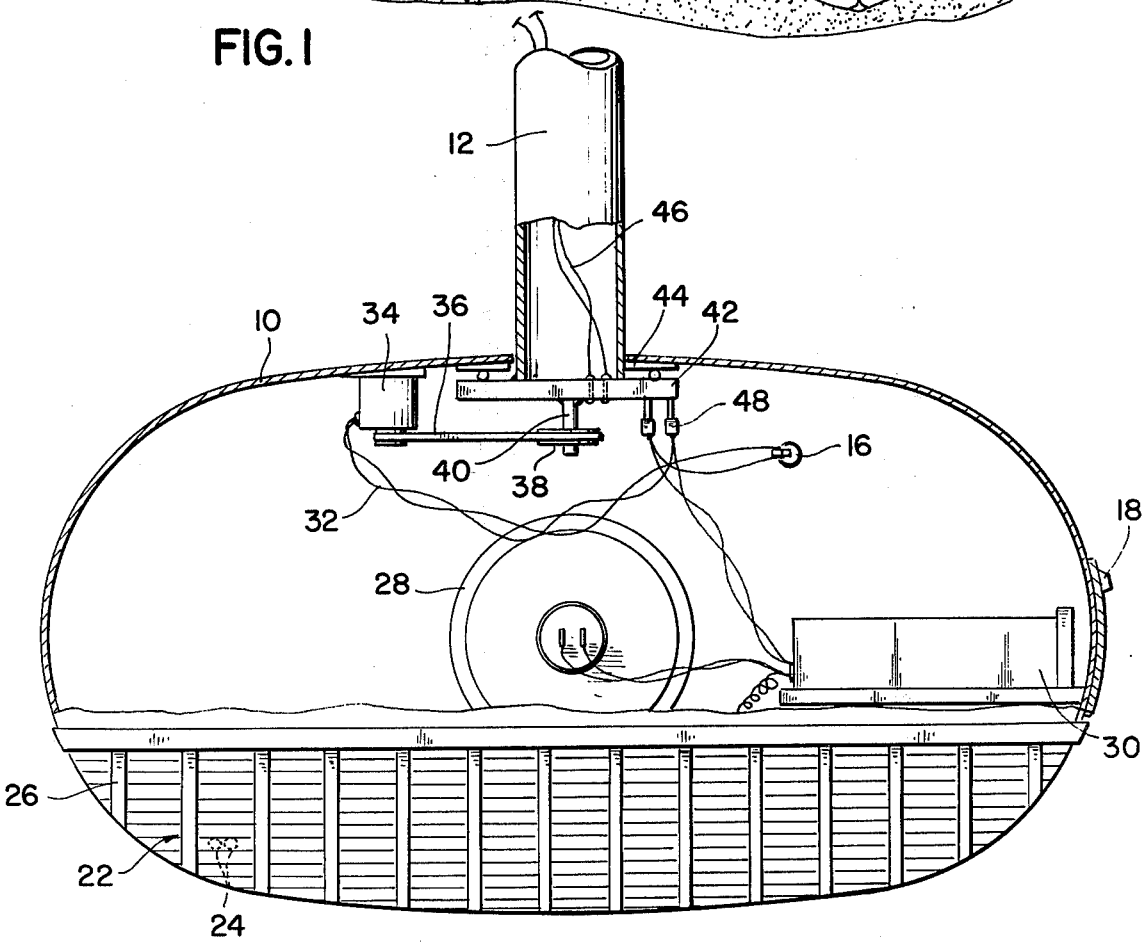
FIG. 2 is a close up in partial cross section of the stereo console and light display.

With regard to FIGS. 1 and 2, a housing 10 is seen attached by a column 12 to a ceiling 14. A rotation control rotater switch 16 mounted on the housing 10 controls the rotation of the housing 10 and an access door 18 provides access to the components within the housing 10. A speaker 20 mounted within the housing 10 provides sound reproduction while a light display 22 using bulbs 24 which illuminate a grating 26 to produce the effect of flames is seen in the lower portion of the housing. Another speaker 28 mounted on an opposite side of the housing 10 from the first speaker 20 permits stereophonic reproduction and the dispersal of sound to the opposite sides of a room. A stereo unit 30 mounted in the housing 10 is connected to the speakers 20 and 28 and to the light display 22 by electrical wires 32. The electrical wieres 32 also connect a rotater electric motor 34 to the rotator switch 16. The motor 34 drives a belt 36. Brushes 38 and a pulley on a shaft 40 are mounted on a support plate 42. The belt 36 connects to the pulley on the shaft 40 so that rotation of the belt 36 will cause the housing 10 to rotate on the thrust bearings 44 which support the housing 10 on the support plate 42. The brushes 38 are connected to external electrical connection wires 46 mounted within the column 12 so that the components within the console housing may be operated.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A stereo console, comprising
   - a housing,
   - a stereo unit mountable in the housing,
   - means of mounting the housing in a room, wherein the means of mounting the housing in a room is a column attached to an upper portion of the housing and mountable to a ceiling of a room, in which
   - two loudspeakers are connected to the stereo unit so as to produce stereophonic reproduction of sound and each loud speaker is mounted to an opposed vertical inclined side of the housing in the mounted position of the housing, with
   - said housing mounted to the column by rotatable means so that the housing may continuously rotate with respect to the column so as to disperse stereophonic sound reproduction to various opposite sides of a room as the housing rotates about a vertical axis with respect to the column, when the column is mounted from a ceiling of a said room.

2. The invention of claim 1, in which the rotatable means comprise
   - a support plate attached to a bottom of the column,
   - a shaft attached to a lower end of the support plate,
   - a pulley mounted on the shaft,
   - the housing mounted on a thrust bearing supported on the support plate, and
   - a motor mounted in the housing and connected by a belt to the pulley, whereby the housing may be rotated on the support plate attached to the column.

3. The console of claim 1, wherein a light bulb is mounted in the console and is electrically connected to an output of the stereo unit, so that the light output of the light bulb is responsive to the output of the stereo unit, together with a grating mounted in an external wall of the housing and located to be illuminated by the said light bulb.

* * * * *